US008095063B2

(12) United States Patent
Ahn et al.

(10) Patent No.: US 8,095,063 B2
(45) Date of Patent: Jan. 10, 2012

(54) IMAGE FORMING APPARATUS AND METHOD THEREOF

(75) Inventors: Byung Sun Ahn, Suwon-si (KR); Jin Min Chung, Yongin-si (KR); Jin Soo Lee, Suwon-si (KR); Min Jae Kim, Nam-gu (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/079,351

(22) Filed: Apr. 4, 2011

(65) Prior Publication Data

US 2011/0176848 A1 Jul. 21, 2011

Related U.S. Application Data

(63) Continuation of application No. 11/956,609, filed on Dec. 14, 2007.

(30) Foreign Application Priority Data

Feb. 1, 2007 (KR) ..... 2007-10656

(51) Int. Cl.
*G03G 15/00* (2006.01)
*B65H 39/10* (2006.01)

(52) U.S. Cl. ..... 399/397; 399/401; 399/405; 271/301; 271/302; 271/304

(58) Field of Classification Search ..... 399/397, 399/401, 405; 271/301, 302, 304
See application file for complete search history.

(56) References Cited

U.S. PATENT DOCUMENTS

| | | | | |
|---|---|---|---|---|
| 4,806,979 | A | 2/1989 | Tokoro et al. | |
| 5,196,897 | A * | 3/1993 | Trask | 399/364 |
| 6,895,211 | B2 * | 5/2005 | Yamashita et al. | 399/400 |
| 2006/0220309 | A1 | 10/2006 | Igarashi | |
| 2006/0228126 | A1 * | 10/2006 | Nihei | 399/82 |

FOREIGN PATENT DOCUMENTS

| | | |
|---|---|---|
| CN | 1501185 | 6/2004 |
| DE | 3341413 | 5/1984 |
| JP | 09-288395 | 11/1997 |

OTHER PUBLICATIONS

European Search Report dated Apr. 30, 2008 in EP Application No. 07123567.5.
Chinese Office Action issued Sep. 11, 2009 in CN Application No. 200810002624.1.
European Oral Proceedings issued May 12, 2011 in EP Application No. 07123567.5.

* cited by examiner

*Primary Examiner* — Matthew G Marini
(74) *Attorney, Agent, or Firm* — Stanzione & Kim, LLP

(57) ABSTRACT

An image forming apparatus having an improved structure to enable a user to conveniently operate the image forming apparatus at a front of the image forming apparatus, and a method thereof. The image forming apparatus includes a main body formed with a discharge port at a front portion, a printing unit mounted inside the main body and disposed adjacent to a front panel of the main body, a feeding unit to feed paper printed by the printing unit toward a rear panel of the main body, and a discharge reversal unit to reverse a moving direction of the paper fed by the feeding unit to feed the paper to the discharge port. A sensor to detect a moving position of the paper and a paper guide guiding movement of the paper is mounted between the feeding unit and the discharge reversal unit.

20 Claims, 4 Drawing Sheets

IMAGE FORMING APPARATUS AND METHOD THEREOF

CROSS-REFERENCE TO RELATED APPLICATIONS

This application is a Continuation Application of U.S. patent application Ser. No. 11/956,609, filed Dec. 14, 2007 in the U.S. Patent and Trademark Office, which claims priority under 35 U.S.C. §119(a) from Korean Patent Application No. 2007-0010656, filed on Feb. 1, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus to enable a user to operate the image forming apparatus at a front of the image forming apparatus, and a method thereof.

2. Description of the Related Art

A conventional image forming apparatus is an apparatus that prints an image on a printing medium, e.g., paper, according to an input image signal. As one example of the conventional image forming apparatus, an electrophotographic image forming apparatus is configured such that a light beam is scanned to a photosensitive member charged with an electric potential to form an electrostatic latent image on an outer peripheral surface of the photosensitive member, the electrostatic latent image is developed into a toner image by adhering a toner onto the electrostatic latent image, and the toner image is transferred and fixed onto paper. The printed paper is discharged outside of a main body of the image forming apparatus by discharge rollers.

The conventional image forming apparatus as described above is classified as either a front-in-side-out (FISO) type or a front-in-front-out (FIFO) type according to a paper feeding direction and a paper discharging direction. The FISO type and the FIFO type have a common feature that a paper supply cassette can be detachably mounted to the front of the main body. However, the FISO type and the FIFO type have differences in the position of a printing unit which prints an image on paper through a developing unit and a transfer unit and a discharge direction of the printed paper. In other words, the FISO type is configured such that the printing unit is disposed adjacent to a side panel of the main body and the printed paper is fed and discharged sideways out of the side panel with respect to the main body. In contrast, the FIFO type is configured such that the printing unit is disposed adjacent to a rear panel of the main body and the printed paper is fed and discharged to a front portion of the main body.

When designing the conventional image forming apparatus, special consideration should be given to printing quality, speed and user convenience.

However, the FISO type image forming apparatus is structurally large, which is inconvenient. Also, when removing jammed paper from the main body, or when replacing expendables in the printing unit, such operations are performed at the side panel of the main body where the printing unit is mounted adjacent thereto. Therefore, there is a problem in that a space for the above operations needs to be freed in a vicinity of the side panel of the main body.

Even though the FIFO type image forming apparatus is slightly more compact than the FISO type image forming apparatus, the FIFO type image forming apparatus includes a complicated paper feeding path for discharging the printed paper to the front of the main body. In addition, similarly to the FISO type, the FIFO type image forming apparatus has problem of freeing a working space. In other words, when removing jammed paper from the main body, or replacing expendables in the printing unit, such operations are performed at the rear panel of the main body, where the printing unit is mounted adjacent thereto. Therefore, there is a problem in that a space for the above operations needs to be freed in a vicinity of the rear panel of the main body.

SUMMARY OF THE INVENTION

The present general inventive concept provides an image forming apparatus that has an improved structure to enable a user to conveniently operate the image forming apparatus at a front portion of the image forming apparatus.

Additional aspects and/or utilities of the general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus including a main body which is formed with a discharge port at a front portion, a printing unit which is mounted inside the main body and disposed adjacent to a front panel of the main body, a feeding unit which feeds paper printed by the printing unit toward a rear panel of the main body, and a discharge reversal unit which reverses a moving direction of the paper fed by the feeding unit to feed the paper to the discharge port.

The image forming apparatus may further include a sensor which is mounted on a paper feeding path between the feeding unit and the discharge reversal unit to detect a moving position of the paper.

The image forming apparatus may further include a paper guide which is mounted between the feeding unit and the discharge reversal unit to guide movement of the paper.

The discharge reversal unit may include a discharge reversal roller which is mounted rotatably in forward and reverse directions, and a discharge reversal backup roller which rotates while contacting the discharge reversal roller.

The image forming apparatus may further include a discharge roller which discharges the paper fed by the discharge reversal unit to an exterior of the main body. The discharge reversal unit may be positioned at a rear of the discharge roller.

The paper guide may include a first guide surface which guides the paper moving from the feeding unit toward the discharge reversal unit, and a second guide surface which guides the paper moving from the discharge reversal unit toward the discharge roller.

The discharge reversal unit may include a discharge reversal roller which is mounted rotatably in forward and reverse directions, and a discharge reversal backup roller which rotates while contacting the discharge reversal roller. A nip portion where the discharge reversal roller contacts the discharge reversal backup roller may be positioned higher than a corner of the paper guide where the first guide surface is contiguous to the second guide surface.

The feeding unit may include a discharge feed roller which rotates by receiving drive power from a driving source, and a feed backup roller which rotates while contacting the discharge feed roller. A nip portion where the discharge reversal roller contacts the discharge reversal backup roller may be positioned higher than a nip portion where the discharge feed roller contacts the feed backup roller.

The image forming apparatus may further include a fixing unit which fixes an image formed on the paper by the printing unit to the paper. The feeding unit may include a discharge feed roller which is mounted rotatably in forward and reverse directions. A sensor may be mounted on a paper feeding path between the fixing unit and the discharge feed roller to detect a moving position of the paper.

The front panel of the main body may be provided to be opened and closed so as to access the printing unit.

The foregoing and/or other aspects and utilities of the present general inventive concept may also be achieved by providing an image forming apparatus including a main body which has a paper feeding path, a printing unit which is provided inside the main body to form an image on paper which moves along the paper feeding path, a fixing unit which fixes the image formed on the paper by the printing unit to the paper, a discharge roller which feeds the paper toward a front panel of the main body and discharges the paper to an exterior of the main body, and a discharge reversal roller which is mounted rotatably in forward and reverse directions at the rear of the discharge roller, and reverses a moving direction of the paper fed from the fixing unit to feed the paper to the discharge roller.

The printing unit and the fixing unit may be mounted adjacent to the front panel of the main body.

The image forming apparatus may further include a discharge feed roller which is disposed on the paper feeding path between the fixing unit and the discharge reversal roller. The discharge feed roller feeds the paper having passed through the fixing unit rearward toward the discharge reversal roller.

The image forming apparatus may further include a sensor which is mounted between the discharge feed roller and the discharge reversal roller to detect a moving position of the paper.

The image forming apparatus may further include a paper guide having a first guide surface which guides movement of the paper between the discharge feed roller and the discharge reversal roller, and a second guide surface which guides movement of the paper between the discharge reversal roller and the discharge roller.

The discharge feed roller may be mounted rotatably in forward and reverse directions, and a sensor may be mounted between the fixing unit and the discharge feed roller to detect a moving position of the paper.

The foregoing and/or other aspects and utilities of the present general inventive concept may also be achieved by providing an image forming apparatus having a main body, including a printing unit disposed within the main body at a first side thereof to print an image on a first surface of a printing medium, a feeding unit to feed the printing medium back to the printing unit after the image has been printed to print another image on a second surface thereof, and a discharge unit to discharge the printing medium outside the main body at the first side thereof.

The discharge unit may include a plurality of discharge rollers to discharge the printing medium outside the main body, and a discharge reversal unit to feed the printing medium to the feeding unit when another image is to be printed or to the plurality of discharge rollers after the image has been printed.

The discharge reversal unit may be located at a second side of the main body.

The image forming apparatus may further include a duplex print path to receive the printing medium from the feeding unit and to feed the printing medium to the printing unit after the image has been printed to print the another image on the second surface thereof.

The feeding unit may include a plurality of rollers to rotate in a first direction to feed the printing medium in a direction toward the discharge unit and then to rotate in a second direction to feed the printing medium to the duplex print path when the another image is to be printed on the second surface of the printing medium.

The plurality of rollers may rotate in the first direction again after the printing medium has been fed to the duplex print path and the another image has been printed to feed the printing medium to the discharge unit to discharge the printing medium outside the main body.

The image forming apparatus may further include a first sensor to detect whether the printing medium has been fed to the printing unit twice, and a second sensor to detect a rear edge of the printing medium as the printing medium is fed to the discharge unit and to discharge the printing medium outside the main body upon detection.

The discharge unit may discharge the printing medium outside the main body after the printing medium has moved past the second sensor during a predetermined period of time.

The feeding unit may feed the printing medium in a direction toward a second side of the main body before being discharged to the first side of the main body.

The image forming apparatus may further include a fixing unit to fix the image onto the printing medium, wherein the feeding unit feeds the printing medium in a direction toward a second side of the main body after the image is fixed onto the printing medium.

The printing medium may pass through the fixing unit a second time to fix the another image onto the printing medium after the image has been fixed.

The foregoing and/or other aspects and utilities of the present general inventive concept may also be achieved by providing a method of feeding a printing medium within an image forming apparatus having a main body, the method including feeding the printing medium to a printing unit to print an image on a first side thereof at a first side of the main body, re-feeding the printing medium to the printing unit a second time to print another image on a second side thereof, and discharging the printing medium outside the main body at the first side thereof.

The method may further include feeding the printing medium to a duplex printing path at the first side of the main body to feed the printing medium to the printing unit the second time.

The method may further include feeding the printing medium in a first direction toward a second side of the main body, and feeding the printing medium in a second direction toward the first side of the main body to feed the printing medium to the duplex print path.

The method may further include feeding the printing medium in the first direction again after the printing medium has been fed to the duplex print path and the another image has been printed on the second side thereof to feed the printing medium to a discharge unit to discharge the printing medium outside the main body.

The method may further include feeding the printing medium to a plurality of discharge rollers to discharge the printing medium outside the main body after the another image has been printed on the second side of the printing medium.

A discharge reversal unit located at a second side of the main body may perform the discharging of the printing medium outside the main body.

The method may further include detecting whether the printing medium has been printed upon twice, detecting a rear edge of the printing medium as the printing medium is fed to the discharge reversal unit, and discharging the printing medium outside the main body upon detection.

The method my further include fixing the image onto the printing medium, and feeding the printing medium in a direction toward a second side of the main body after the image is fixed onto the printing medium.

The method may further include fixing the another image onto the printing medium after being fed in the direction toward the second side of the main body.

The foregoing and/or other aspects and utilities of the present general inventive concept may also be achieved by providing a method of feeding a printing medium within an image forming apparatus having a main body, the method comprising feeding the printing medium to a printing unit adjacent to a first side of the main body to print an image on the printing medium, feeding the printing medium to a second side of the main body after the image has been printed on the printing medium, and reversing a moving direction of the printing medium to discharge the printing medium outside the main body.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
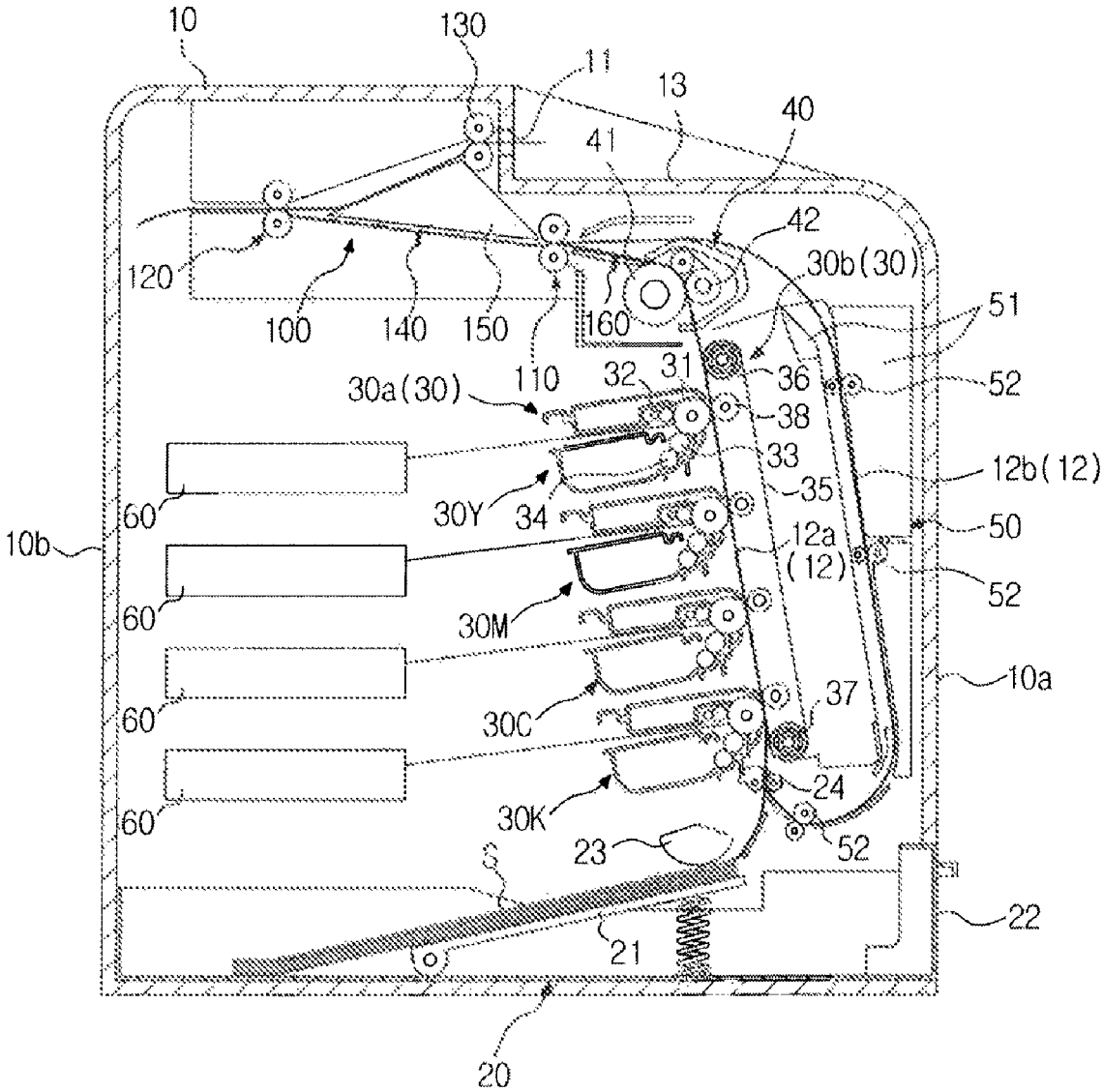
FIG. 1 is a side-sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
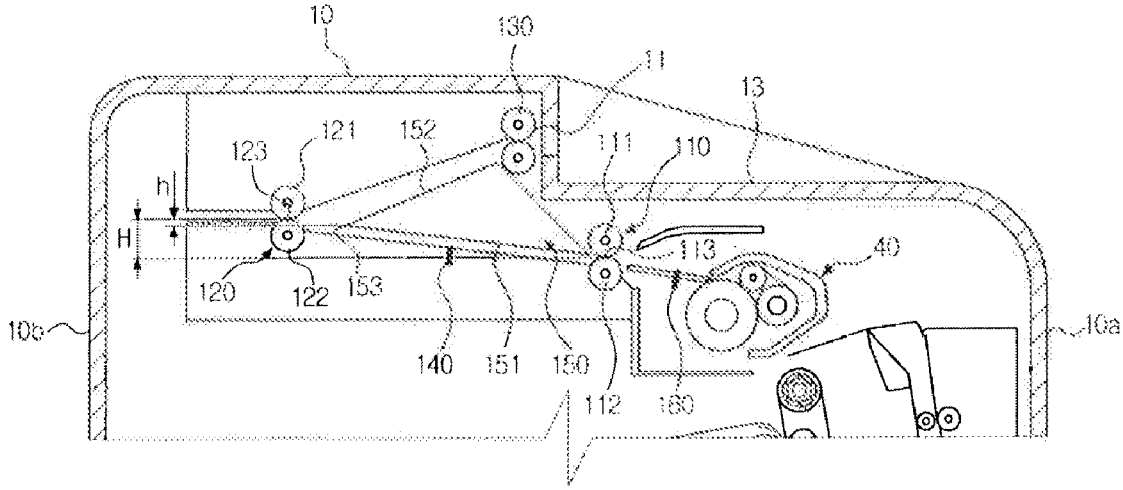
FIG. 2 is a view illustrating a portion extracted from FIG. 1.

FIG. 1 is a side-sectional view illustrating an image forming apparatus according to an embodiment of the present general inventive concept, and FIG. 2 is a view illustrating a portion extracted from the image forming apparatus of FIG. 1.

As illustrated in FIG. 1, the image forming apparatus according to an embodiment of the present general inventive concept includes a main body 10 which forms an exterior appearance and supports components mounted therein, a paper supply unit 20 which supplies paper S upon which an image is to be printed, a printing unit 30 which prints the image on the paper S using a developing unit 30*a* and a transfer unit 30*b*, a fixing unit 40 which fixes the printed image onto the paper S, a paper discharge unit 100 which discharges the printed paper S outside through a discharge port 11 formed at the front portion of the main body 10, and a duplex printing unit 50 to print an image on another surface of the paper S. Thus, the duplex printing unit 50 provides that a printing operation is performed on two sides of the paper S as the paper S is fed through the image forming apparatus.

A paper feeding path 12, through which the paper S moves, is defined inside the main body 10. The paper feeding path 12 includes a print path 12*a* and a duplex-print circulation path 12*b*. While the paper S passes through the print path 12*a*, the printing operation is performed by the developing unit 30*a* and the transfer unit 30*b*. When performing the duplex print operation, the paper S which is printed on one surface passes through the duplex-print circulation path 12*b* to be guided to an upstream side of the printing unit 30.

The paper supply unit 20 includes a paper supply cassette 22 which has a paper tray 21 on which the paper S to be printed is loaded, a pickup roller 23 which picks up the paper S loaded on the paper tray 21 sheet by sheet, and a feed roller 24 which feeds the picked-up paper S toward the printing unit 30. The paper supply cassette 22 is detachably mounted to a lower portion of a front panel 10*a* of the main body 10.

The developing unit 30*a* includes four developing devices 30Y, 30M, 30C and 30K, in which toners of different colors, e.g., yellow (Y), magenta (M), cyan (C) and black (K), are respectively contained. Each of the developing devices 30Y, 30M, 30C and 30K are provided with photosensitive members 31 on which an electrostatic latent image is formed by respective exposure units 60. The respective exposure units 60 irradiate light corresponding to image information of yellow (Y), magenta (M), cyan (C) and black (K) to the photosensitive members 31 of the respective developing devices according to a print signal.

Each of the developing devices 30Y, 30M, 30C and 30K includes a charge roller 32 to charge each of the photosensitive members 31 to a predetermined electric potential, a developing roller 33 to develop the electrostatic latent image formed on each of the photosensitive members 31 into a toner image, and a supply roller 34 to supply the toner to the developing roller 33 and to adhere the toner thereto.

The transfer unit 30*b* transfers the toner image developed on the photosensitive members 31 to the paper S. The transfer unit 30*b* includes a transfer belt 35 which circulates while contacting the photosensitive members 31, a driving roller 36 which drives the transfer belt 35, a tension roller 37 which maintains a constant tensile force of the transfer belt 35, and four transfer rollers 38 which transfer the toner image developed on the photosensitive members 31 onto the paper S.

The fixing unit 40 is included to fix the transferred image onto the paper S by applying heat and pressure to the paper S. The fixing unit 40 includes a heat roller 41 which has a heat source to heat the toner-transferred paper S and a press roller 42 which is disposed opposite to the heat roller 41 and maintains a constant fixing pressure with the heat roller 41.

The duplex printing unit 50 is can feed the paper S, which has an image printed on one surface, toward the upstream side of the printing unit 30 so as to perform another print operation on another surface of the paper S. The duplex printing unit 50 includes a guide frame 51 which forms the duplex-print circulation path 12*b*, and duplex-print feed rollers 52 which are mounted on the duplex-print circulation path 12*b* to feed the paper S.

In the embodiment of FIG. 1, the printing unit 30, the fixing unit 40, the print path 12*a*, and the duplex-print circulation path 12*b* are disposed adjacent to the front panel 10*a* of the main body 10. The front panel 10*a* of the main body 10 may be opened and closed so as to access the printing unit 30, the fixing unit 40, the print path 12*a*, and the duplex-print circulation path 12*b*. Accordingly, when replacing expendable components (i.e., a toner cartridge, etc.) in the printing unit 30 or the fixing unit 40, or when removing jammed paper S from the print path 12*a* or the duplex-print circulation path 12*b*, a user can perform the above functions at the front of the image forming apparatus, thereby increasing convenience in use. Further, it is unnecessary to free a space around the image forming apparatus to perform the above replacement or jammed paper S removal operations. Accordingly, the user can utilize space around the image forming apparatus more efficiently.

As described above, when the printing unit 30, the fixing unit 40, the print path 12*a*, and the duplex-print circulation path 12*b* are disposed adjacent to the front panel 10*a* of the main body 10, the paper S having passed through the fixing unit 40 is directed toward a rear panel 10*b* of the main body 10. Accordingly, the paper discharge unit 100 is configured to reverse the moving direction of the paper S fed toward the rear panel 10*b* of the main body 10 and discharge the paper to the front of the main body 10.

As illustrated in FIGS. 1 and 2, the paper discharge unit 100 includes a feeding unit 110 which feeds the paper S having passed through the fixing unit 40 toward the rear panel 10*b* of the main body 10, a discharge reversal unit 120 which reverses the moving direction of the paper S fed by the feeding unit 110, and discharge rollers 130 which are disposed between the discharge reversal unit 120 and the discharge port 11 and discharge the paper S fed by the discharge reversal unit 120 to a discharge tray 13 formed on a top surface of the main body 10.

The discharge reversal unit 120 is configured to feed the paper S toward the rear panel 10*b* of the main body 10 during a predetermined time period and then reverse the moving direction of the paper S at a specific point of time so that the paper moves toward the discharge port 11 formed at the front portion of the main body 10. The discharge reversal unit 120 is disposed at a rear of the discharge rollers 130. The discharge reversal unit 120 includes a discharge reversal roller 121 which is mounted to be rotatable in forward and reverse directions, and a discharge reversal backup roller 122 which contacts the discharge reversal roller 121 to rotate together therewith. The discharge reversal roller 121 rotates by receiving a drive power from a driving source (not illustrated).

The image forming apparatus further includes a sensor 140 which is provided between the feeding unit 110 and the discharge reversal unit 120 to detect a position of the moving paper S. If the sensor 140 detects the passing of a rear end of the paper S, the rotational direction of the discharge reversal roller 121 is reversed to feed the paper S in the reverse direction after an elapse of a predetermined time.

The image forming apparatus further includes a paper guide 150 which is provided between the feeding unit 110 and the discharge reversal unit 120 to guide the movement of the paper S. The paper guide 150 includes a first guide surface 151 which guides the paper S moving from the feeding unit 110 to the discharge reversal unit 120, and a second guide surface 152 which guides the paper S whose moving direction is reversed by the discharge reversal unit 120 to the discharge rollers 130. The embodiment of FIGS. 1 and 2 illustrates that the paper guide 150 having both the first guide surface 151 and the second guide surface 152 is provided to guide the movement of the paper S between the feeding unit 110 and the discharge reversal unit 120 and between the discharge reversal unit 120 and the discharge rollers 130. However, an embodiment of the present general inventive concept can also be modified to include a first paper guide having the first guide surface 151 and a second paper guide having the second guide surface 152 provided separately.

In the paper discharge process, the feeding unit 110 feeds the paper S having passed through the fixing unit 40 to the discharge reversal unit 120. In the duplex printing process, the feeding unit 110 reverses the moving direction of the paper S at a specific point of time to feed the paper S to the duplex-print circulation path 12*b*. The feeding unit 110 includes a discharge feed roller 111 which rotates by receiving a drive power from the driving source (not illustrated), and a feed backup roller 112 which contacts the discharge feed roller 111 to rotate together therewith. The discharge feed roller 111 is provided to be rotatable in forward and reverse directions.

The image forming apparatus of FIGS. 1 and 2 further includes a sensor 160 which is provided between the fixing unit 40 and the feeding unit 110 to detect the position of the moving paper. If the sensor 160 detects the passing of the rear end of the paper in the duplex print mode, the rotational direction of the discharge feed roller 111 is reversed to feed the paper in the reverse direction after the elapse of a predetermined time.

A nip portion 123 of the discharge reversal unit 120, where the discharge reversal roller 121 contacts the discharge reversal backup roller 122, may be positioned higher than a corner 153 of the paper guide 150 where the first guide surface 151 is contiguous to the second guide surface 152. If the moving direction of the paper S guided by the first guide surface 151 is reversed by the discharge reversal roller 121, the rear end of the paper S having passed through the paper guide 150 moves again toward the paper guide 150. At this time, because the corner 153 of the paper guide 150 is positioned lower than the nip portion 123 of the discharge reversal unit 120, the rear end of the paper S can be smoothly fed to the second guide surface 152 without an additional paper guide member. FIG. 2 illustrates an exemplary embodiment in which the nip portion 123 is positioned higher than the corner 153 by a height h.

The nip portion 123, where the discharge reversal roller 121 contacts the discharge reversal backup roller 122, may also be positioned higher than a nip portion 113 where the discharge feed roller 111 contacts the feed backup roller 112. FIG. 2 illustrates an exemplary embodiment in which the nip portion 123 is positioned higher than the nip portion 113 by a height H.

Figure 3:
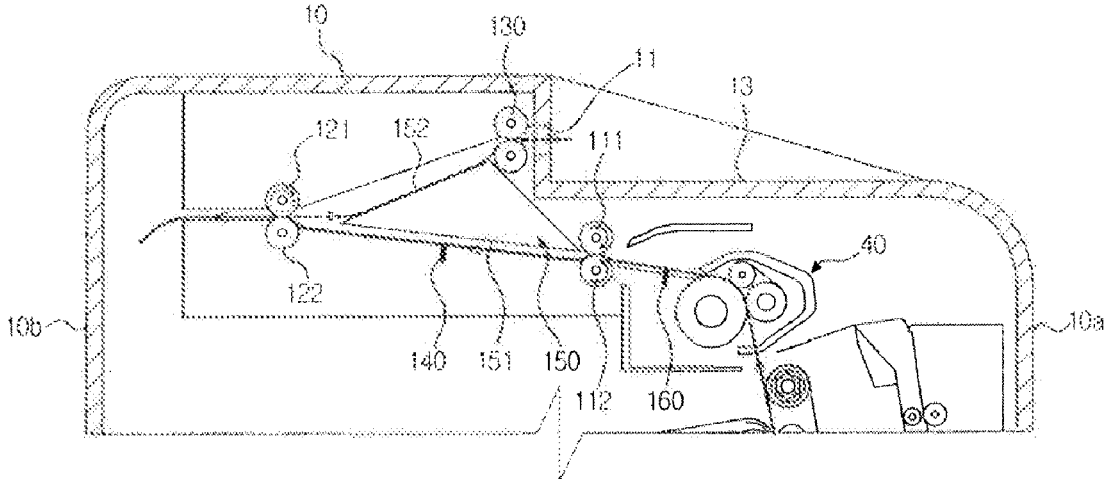
FIG. 3 is a view illustrating an operation of discharging printed paper in the image forming apparatus of FIG. 1 according to an embodiment of the present general inventive concept.
Figure 4:
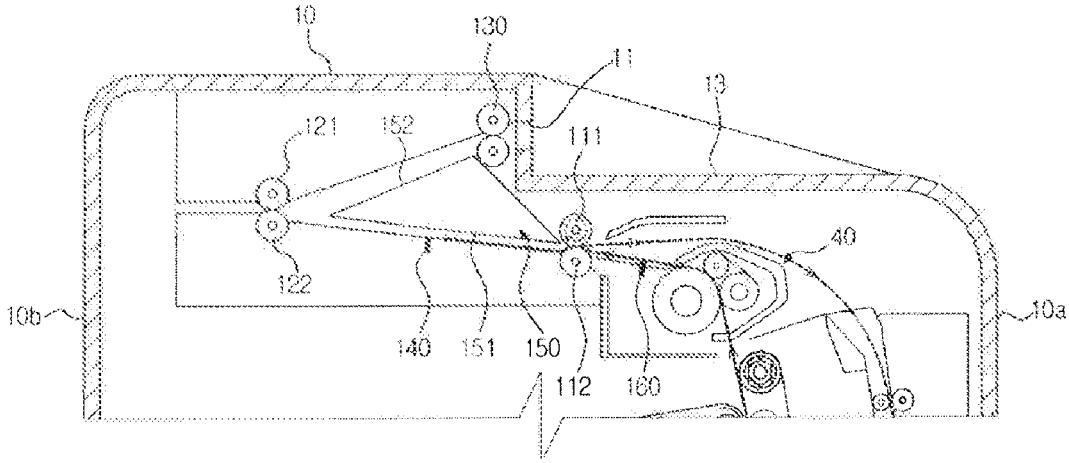
FIG. 4 is a view illustrating a duplex printing operation in the image forming apparatus of FIG. 1 according to an embodiment of the present general inventive concept.

Hereinafter, the operation of the image forming apparatus according to an embodiment of the present general inventive concept will be described with reference to FIGS. 1, 3 and 4.

The print operation and the paper discharge operation will be first described. As illustrated in FIGS. 1 and 3, if a print command is input, the respective exposure units 60 irradiate light corresponding to image information of yellow, magenta, cyan and black colors to the photosensitive members 31 of the respective developing devices 30Y, 30M, 30C and 30K to form the electrostatic latent image on the surface of the photosensitive members 31. The developing rollers 33 of the respective developing devices 30Y, 30M, 30C and 30K supply the toner to the respective photosensitive members 31 to develop the electrostatic latent image on the respective photosensitive members 31 into the yellow, magenta, cyan and black toner image.

The paper S picked up by the pickup roller 23 is attached to the transfer belt 35 and fed at the same speed as the running speed of the transfer belt 35. A voltage of an opposite polarity to the toner adhering to the photosensitive members 31 is applied to the transfer rollers 38, and the toner image on the photosensitive members 31 is transferred onto the paper S. As the paper S is fed, the yellow, magenta, cyan and black toner image formed on the respective photosensitive members 31 is overlappingly transferred onto the paper S in sequence, so that the complete color toner image is formed on the paper S.

The toner image transferred onto the paper S is fixed to the paper S while the paper S passes through the fixing unit 40.

The paper S having passed through the fixing unit 40, is fed toward the rear panel 10*b* of the main body 10 by the discharge feed roller 111. At this time, the movement of the paper S is guided by the first guide surface 151 of the paper guide 150. If the front end of the paper S advances to the discharge reversal roller 121, the paper S is continuously fed toward the rear panel 10*b* of the main body 10 by the discharge reversal roller 121.

The paper S moving as described above is detected by the sensor 140, which is disposed between the discharge feed roller 111 and the discharge reversal roller 121. If the sensor 140 detects the rear end of the paper S, the rotational direction of the discharge reversal roller 121 is reversed to feed the paper S in the reverse direction after a predetermined amount of time elapses. The paper S is guided by the second guide surface 152 of the paper guide 150 and fed toward the discharge port 11 formed at the front portion of the main body 10. Then, the paper is discharged to the discharge tray 13 formed on the top surface of the main body 10 by the discharge rollers 130. A dotted line in FIG. 3 refers to the paper which is fed by the discharge reversal roller 121, whose rotational direction is reversed.

Next, the duplex print operation will be described with reference to FIGS. 1 and 4. The paper S, which has been printed on one surface and passed through the fixing unit 40, moves toward the discharge feed roller 111. The paper S moving toward the discharge feed roller 111 is detected by the sensor 160, which is disposed between the fixing unit 40 and the discharge feed roller 111. If the sensor 160 detects the rear end of the paper S, the rotational direction of the discharge feed roller 111 is reversed to feed the paper S in the reverse direction after the elapse of a predetermined time. The paper S advances into the duplex-print circulation path 12*b*, and is fed toward the upstream side of the printing unit 30 by the duplex-print feed rollers 52. While undergoing again the developing, transferring and fixing processes, the other surface of the paper S is printed upon. The duplex-printed paper S passes again through the fixing unit 40 and is discharged outside of the main body 10 through the paper discharge operation as described above with reference to FIG. 3.

As apparent from the above description, an image forming apparatus according to an embodiment of the present general inventive concept is configured such that a paper upon which an image is to be printed is supplied from a front portion of the image forming apparatus, and the printed paper is discharged to the front portion of the image forming apparatus. In addition, the user is enabled to easily remove jammed paper, or replace expendables in the apparatus, at the front of the apparatus. Accordingly, convenience in use increases, and space around the image forming apparatus can be utilized more efficiently.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus, comprising:

a main body having a discharge port facing towards a front panel of the main body;

a printing unit mounted inside the main body to perform a printing operation on a first surface of a print medium, the printing unit including a plurality of developing devices mounted inside the main body and a transfer belt arranged between the plurality of developing devices and the front panel;

a feeding unit to feed a print medium passing through the printing unit towards a rear panel of the main body; and a discharge reversal unit arranged in a rear region of the main body to feed the print medium toward the rear panel of the main body along a single path between the discharge reversal unit and the rear panel in a forward direction and to cause the print medium to move in a reverse direction, wherein, while a portion of the print medium is disposed in the single path, the print medium moved in the reverse direction by the discharge reversal unit is selectively fed to either the discharge port to discharge the print medium or to a duplex-print circulation path in which the print medium is fed back to the printing unit by moving through a portion of the duplex-print circulation path located between the transfer belt and the front panel of the main body so as to perform a printing operation on a second surface of the print medium.

2. The image forming apparatus according to claim 1, wherein the feeding unit comprises:

a discharge feed roller arranged to rotate by receiving a drive power from a driving source; and a feed backup roller arranged to rotate while contacting the discharge feed roller.

3. The image forming apparatus according to claim 2, wherein the discharge reversal unit comprises:

a discharge reversal roller mounted rotatably in forward and reverse directions; and a discharge reversal backup roller arranged to rotate while contacting the discharge reversal roller.

4. The image forming apparatus according to claim 3, further comprising:

a paper guide having a first guide surface to guide movement of the print medium moved in the reverse direction by the discharge reverse unit toward the duplex-print circulation path, wherein the paper guide further has a second guide surface to guide movement of the print medium moved in the reverse direction by the discharge reverse unit toward the discharge port.

5. The image forming apparatus according to claim 4, further comprising:

a nip portion where the discharge reversal roller contacts the discharge reversal backup roller, the nip portion positioned higher than a corner of the paper guide where the first guide surface is contiguous to the second guide surface.

6. The image forming apparatus according to claim 3, further comprising:

a discharge roller to discharge the print medium fed by the discharge reversal unit to an exterior of the main body, wherein the discharge roller is adjacent to the discharge port.

7. The image forming apparatus according to claim 6, wherein the discharge roller is positioned higher than the discharge reversal unit.

8. The image forming apparatus according to claim 6, wherein the discharge reversal unit is positioned at a rear of the discharge roller, and the feeding unit is positioned closer to the front portion of the main body than the discharge roller.

9. The image forming apparatus according to claim 3, wherein a nip portion where the discharge reversal roller contacts the discharge reversal backup roller is positioned higher than a nip portion where the discharge feed roller contacts the feed backup roller.

10. The image forming apparatus according to claim 1, wherein a front panel of the main body is provided to be opened and closed to access the printing unit and a duplex printing unit through the front panel of the main body.

11. The image forming apparatus according to claim 1, further comprising:

a sensor mounted between the feeding unit and the discharge reversal unit to detect a moving position of the print medium.

12. The image forming apparatus according to claim 1, further comprising:

a fixing unit to fix an image formed on the print medium by the printing unit.

13. The image forming apparatus according to claim 1, wherein the printing medium picked up from a paper tray travels in a C-shaped path with an open side of the C-shaped path facing towards the rear region of the main body.

14. The image forming apparatus according to claim 13, wherein an acute angle is formed between a first imaginary straight line extending between the feeding unit and the discharge reversal unit and a second imaginary straight line extending between the discharge reversal unit and the discharge port.

15. The image forming apparatus according to claim 1, wherein, if a duplex printing operation is selected and a print operation on the second surface of the print medium has not been performed, the print medium moving in the reverse direction by the discharge reversal unit is controlled so as to be fed to the duplex-print circulation path.

16. The image forming apparatus according to claim 15, wherein if a simplex printing operation is selected, the print medium moving in the reverse direction by the discharge reversal unit is controlled so as to be fed to the discharge port.

17. The image forming apparatus according to claim 1, wherein the discharge reversal unit is arranged to feed the print medium from the feeding unit toward the rear panel of the main body in the forward direction until a leading edge of the print medium has passed through the discharge reversal unit and before a trailing edge of the print medium passes through the discharge reverse unit.

18. A method of feeding a print medium within an image forming apparatus having a main body including a front region and a rear region, the method comprising:

feeding the print medium to a printing unit to print an image on a first side of the print medium;

feeding the print medium from a feeding unit to a discharge reversal unit arranged in the rear region of the main body;

using the discharge reversal unit to feed the printing medium in a forward direction toward the rear region of the main body along a single path between the discharge reversal unit and the rear region and subsequently to reverse a moving direction of the print medium toward the front region of the main body; and selectively feeding the print medium moved in the reverse direction by the discharge reversal unit, while a portion of the print medium is disposed in the single path, to either a discharge port to discharge the print medium or to a duplex-print circulation path in which the print medium is fed back to the printing unit by moving through a portion of the duplex-print circulation path located between a transfer belt and a front panel of the main body so as to perform a printing operation on a second surface of the print medium.

19. The method of claim 18, wherein the print medium is fed toward the rear region of the main body until a leading edge of the print medium has passed through the discharge reversal unit and before a trailing edge of the print medium passes through the discharge reverse unit.

20. The method of claim 19, wherein if a simplex printing operation is selected, the print medium being moved in the reverse direction by the discharge reversal unit is controlled so as to be fed to the discharge port.

* * * * *